United States Patent [19]

Hackbarth et al.

[11] 4,113,808

[45] Sep. 12, 1978

[54] CARBURETOR HAVING AN AUTOMATIC CHOKE

[75] Inventors: Eugene R. Hackbarth, Kenosha; Russell J. Van Rens, Milwaukee, both of Wis.

[73] Assignee: Outboard Marine Corporation, Waukegan, Ill.

[21] Appl. No.: 780,590

[22] Filed: Mar. 24, 1977

[51] Int. Cl.[2] ..... F02M 1/14

[52] U.S. Cl. ..... 261/52; 261/64 C

[58] Field of Search ..... 261/64 C, 52

[56] References Cited

U.S. PATENT DOCUMENTS

| | | | |
|---|---|---|---|
| 1,887,386 | 11/1932 | Westover | 261/52 |
| 1,957,289 | 5/1934 | Purpura | 261/64 C |
| 1,969,358 | 8/1934 | Coffelder | 261/64 C |
| 2,010,206 | 8/1935 | Timian | 261/52 |
| 2,015,752 | 10/1935 | Hunt | 261/52 |
| 3,272,486 | 9/1966 | Lucas et al. | 261/52 |
| 3,484,220 | 12/1969 | Jones | 261/64 C |
| 3,625,492 | 12/1971 | Reichenbach et al. | 261/64 C |

*Primary Examiner*—Tim R. Miles

*Attorney, Agent, or Firm*—Michael, Best & Friedrich

[57] ABSTRACT

Disclosed herein is a carburetor for internal combustion engines having an automatic choke control mechanism including a vacuum diaphragm assembly operatively connected to a choke lever for opening a spring-biased closed choke valve and holding it open at idling and lower engine speeds and a linkage arrangement interconnecting a throttle valve lever and the choke lever for holding the choke valve open at higher engine speeds independently of the vacuum diaphragm assembly. The linkage arrangement includes a spring-biased choke pull-out lever which is held in a locked position during engine idling and lower engine speeds by a link having one end slidably received in a slot in the choke pull-out lever and the other end connected to the throttle lever. As the throttle lever is moved past a predetermined advance speed position, the link is moved to a released position in the choke pull-out lever slot wherein the choke pull-out lever is urged into abutting engagement with the choke lever to hold the choke valve open. As the throttle lever is returned toward the engine idling position past the predetermined advance speed setting, the link returns the choke pull-out lever to the locked position and the choke lever is again controlled by the vacuum diaphragm assembly.

5 Claims, 4 Drawing Figures

CARBURETOR HAVING AN AUTOMATIC CHOKE

BACKGROUND OF THE INVENTION

This invention relates to carburetors for internal combustion engines and, more particularly, to automatic choke control mechanisms for such carburetors.

In one type of prior art automatic choke control mechanisms for internal combustion engine carburetors, the choke valve is controlled in response to temperature by a thermostatic element and is initially opened in response to engine suction pressure by a vacuum diaphragm assembly connected in communication with the engine intake manifold. In another type, the choke valve is controlled solely by a vacuum diaphragm assembly connected in communication with the engine intake manifold or with the carburetor induction passage upstream of the throttle valve. The latter type of automatic choke control mechanism generally is not effective for many engines which, at higher speeds, do not produce a suction pressure sufficiently low enough for the vacuum diaphragm assembly to maintain the choke valve in an open position.

Examples of these types of automatic choke control mechanisms are disclosed in the following U.S. Pat. Nos.:

Hill, 3,085,792, issued Apr. 16, 1963;
Lechtenberg, et al., 3,194,224, issued July 13, 1965;
Lucas et al. 3,272,486, issued Sept. 13, 1966;
Jones, 3,484,220 issued Dec. 16, 1969;
Reichenbach, et al. 3,625,492 issued Dec. 7, 1971;

SUMMARY OF THE INVENTION

The invention provides an automatic choke control mechanism for internal combustion engine carburetors which control mechanism is arranged to control the choke valve in response to engine intake manifold pressure at idling and lower engine speeds and in response to the position of the throttle valve at higher engine speeds.

More specifically, the invention provides a carburetor for internal combustion engines including a body defining an induction passage, a choke valve mounted in the induction passage and movable between a closed position and an open position to control the admission of air into the induction passage, a pressure responsive means adapted for communication with the engine intake, means connecting the pressure responsive means to the choke valve for moving the choke valve to the open position in response to the presence of subatmospheric pressure in the engine intake during engine operation, a throttle valve mounted in the induction passage between the choke valve and the carburetor outlet and movable between an engine idle position and a range of advanced speed positions, and means interconnecting the throttle valve and the choke valve for holding the choke valve in the open position independently of the pressure responsive means after the throttle lever is moved from the idle position past the predetermined speed position and for permitting the pressure responsive means to be effective for controlling movement of the choke valve when the throttle valve is moved past the predetermined speed position toward the idle position.

In one embodiment, the choke valve is pivotally mounted in the induction passage and includes first biasing means for pivoting the choke valve toward the closed position and a choke lever connected to the choke valve for common pivotal movement therewith. A first link connected between the pressure responsive means and the choke lever pivots the choke lever, in response to the presence of subatmospheric pressure in the engine intake, to open the choke valve against the closing force of the first biasing means.

In one embodiment, the throttle valve is pivotally mounted in the induction passage and includes a throttle lever connected to the throttle valve for common pivotal movement therewith. The throttle lever and the choke lever are interconnected by a choke pull-out lever which is mounted for pivotal movement between a locked position and a released position wherein the choke pull-out lever engages the choke lever and is operable for pivoting a choke lever toward the open position, a second biasing means is provided for pivoting the choke pull-out lever toward the released position and for overcoming the first biasing means, and thereby holding the choke valve in the open position when the choke pull-out lever is in the released position, and the throttle lever is connected to the choke pull-out lever by means which are arranged to lock the choke pull-out lever in the locked position when the throttle lever is located in the idle position or between the idle position and the predetermined advance speed position and to permit the second biasing means to pivot the choke pull-out lever to the released position when the choke lever is moved from the idle position past the predetermined advance speed position.

In one embodiment, the choke pull-out lever has a first leg which includes an elongated slot and an outer end portion pivotally mounted on the carburetor body and a second leg which includes an outer end portion adapted to engage the choke lever, and the throttle lever is connected to the choke pull-out lever by a second link having one end pivotally connected to the throttle lever and a second end slidably received in the choke pull-out lever slot. The second end of the second link engages one end of the choke pull-out lever slot and holds the choke pull-out lever in the locked position when the throttle lever is located in the idle position or between the idle position and the predetermined advanced speed position. The second end of the second link, in response to movement of the throttle lever from the idle position past the predetermined advanced speed position, is moved in the choke pull-out lever slot towards the opposite end thereof to a released position wherein the second biasing means can pivot a choke pull-out lever toward the released position.

A principal feature of the invention is the provision of a carburetor for internal combustion engines including an automatic choke control mechanism which is arranged to control the position of the choke valve throughout a full range of engine speeds without the use of thermostatic element.

Another principal feature of the invention is a provision of such a choke control mechanism which controls the position of the choke valve in response to the engine intake pressure at idling and lower engine speeds and in response to the position of the carburetor throttle valve at higher engine speeds.

A further principal feature of the invention is the provision of a carburetor for internal combustion engines having an automatic choke control mechanism including a pressure responsive means for opening the choke valve when the engine is started and operating at lower speeds and a linkage arrangement interconnecting the carburetor throttle valve and the choke valve for holding the choke valve open independently of the pressure responsive means when the engne is operating at higher speeds.

Other features and advantages of the embodiments of the invention will become apparent to those skilled in the art upon reviewing the following detailed description, the drawing and the appended claims.

Figure 1:
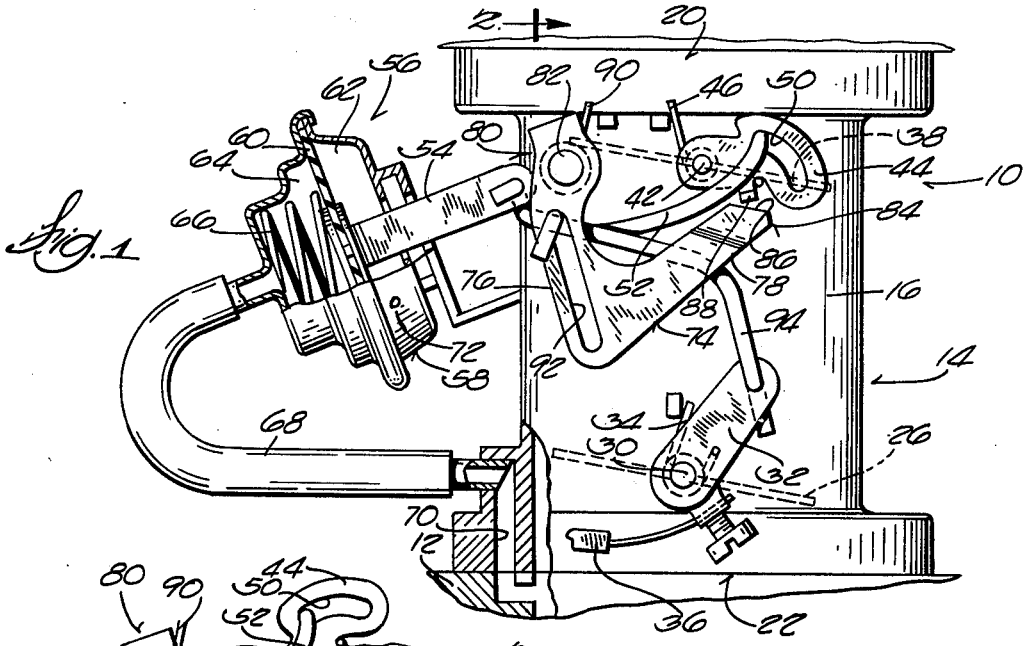
FIG. 1 is an elevational view, partially cut away and cross sectioned, of a carburetor for an internal combustion engine embodying various of the features of the invention, illustrating the position of various components when the engine is shut down.

Before explaining at least one embodiment of the invention in detail, it is to be understood that the invention is not limited in its application to the details of construction and the arrangements of the components set forth in the following description or illustrated in the drawing. The invention is capable of other embodiments and of being practiced and carried out in various ways. Also, it is to be understood that the phraseology and terminology employed herein is for the purpose of description and should not be regarded as limiting.

DESCRIPTION OF THE PREFERRED EMBODIMENTS

Illustrated in the drawing is a carburetor 10 mounted on the intake manifold 12 (illustrated fragmentarily) of an internal combustion engine, such as the engine for an outboard motor. The carburetor 10 (See FIGS. 1 and 2) has a housing 14 including a body 16 defining an air-fuel induction passage 18 having an air inlet 20 connected in communication with the atmosphere in the usual manner, an outlet 22 adapted to communicate with the engine intake manifold 12, and a venturi section 24.

Pivotally mounted in the induction passage 18 between the venturi section 24 and the outlet 22 is a butterfly type throttle valve 26 carried on a shaft 28 which is suitably journaled in the carburetor body 16 and includes an outer end portion 30 projecting laterally outwardly from the body 16. Fixed on the outer end portion 30 of the throttle valve shaft 28 for pivoting the throttle valve 26 between an engine idle position shown in FIG. 1 and a range of advance speed positions is a throttle lever 32. The throttle valve 26 is urged toward the idle position (i.e., in the counterclockwise direction as viewed in FIGS. 1 and 4) by a torsion spring 34 encircling the outer end portion 30 of the throttle valve shaft 28 with the opposite ends thereof suitably bearing against the housing 14 and the throttle lever 32. The throttle valve 26 is conventionally pivoted from the idle position to an advance speed position against the biasing spring of the throttle lever spring 34 (i.e., in the clockwise direction as viewed in FIGS. 1 and 4), by a linkage or push-pull cable 36 connected between the throttle lever 32 and a remote throttle control means (not shown).

Figure 3:
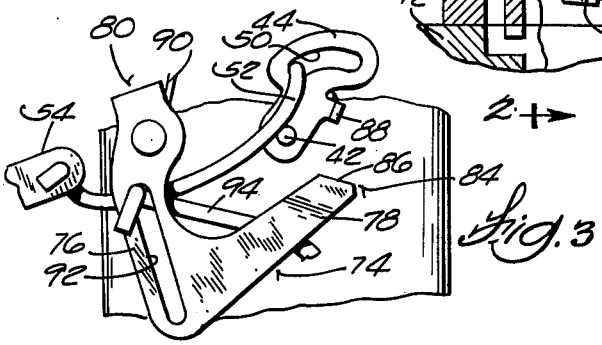
FIG. 3 is a fragmentary elevational view of the carburetor shown in FIG. 1, illustrating the position of various components when the engine is operating with the throttle at idling or low speed positions.
Figure 4:
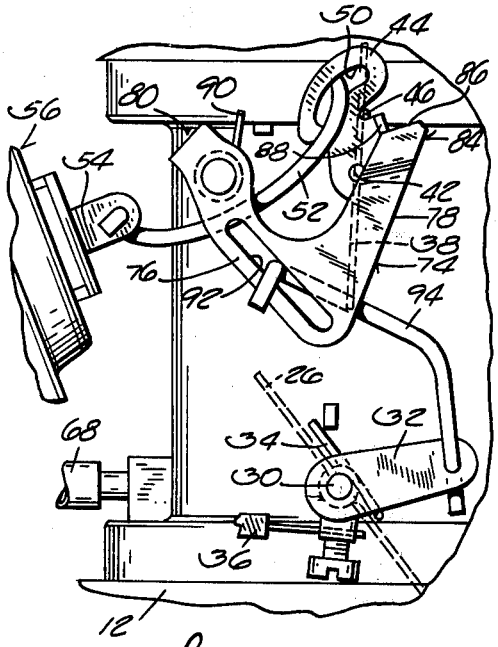
FIG. 4 is a fragmentary, elevational view similar to FIG. 1, illustrating the position of various components when the engine is operating with the throttle at a high speed position.
Figure 2:
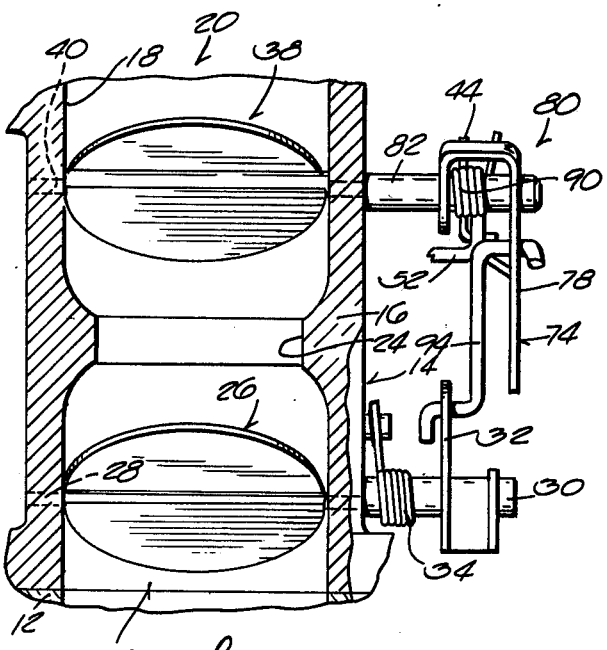
FIG. 2 is a sectional view taken generally along line 2—2 in FIG. 1.

Pivotally mounted in the induction passage 18 (See FIG. 2) between the air inlet 20 and the venturi section 24 for controlling the admission of air into the induction passage 28 through the air inlet 20 is a butterfly type choke valve 38 carried on a shaft 40 which is suitably journaled in the carburetor body 16 and includes an outer end portion 42 projecting laterally outwardly from the body 16 on the same side as the outer end portion 30 of the throttle valve shaft 28. Fixed on the outer end portion 42 of the choke valve shaft 40 for pivoting the choke valve between a closed position shown in FIGS. 1 and 2 and an open position shown in FIGS. 3 and 4 is a choke lever 44. In the specific construction illustrated, the choke valve 48 has a generally elliptical shape so it is not perpendicular to the direction of flow through the circular induction passage 18 when in the closed position as illustrated in FIGS. 1 and 2.

The choke valve 38 is urged towards the closed position (i.e., in a clockwise direction as viewed in FIG. 1), when the engine is not operating, by a torsion spring 46 encircling the outer end portion 42 of the choke valve shaft 40 with the opposite ends thereof suitably bearing against the housing 14 and the choke lever 44.

Pressure responsive means are provided for opening the choke valve 38 against the biasing force of the choke lever spring 46 in response to subatmospheric pressure produced in the engine intake manifold 12 when the engine is started. While various arrangements can be used, in the specific construction illustrated, such means comprises an arcuate slot 50 in the choke valve lever 44 slidably receiving one end of a link 52 which, at the other end, is pivotally connected to the outer end of a stem 54 of a conventional vacuum diaphragm assembly 56 suitably mounted on the carburetor housing 14.

The vacuum diaphragm assembly 56 includes a housing 58 and a diaphragm 60 which is located inside the housing 58 and is suitably secured at the periphery to divide the interior of the housing 58 into a vent chamber 62 and a vacuum chamber 64. The inner end of the stem 54 is suitably secured to the central portion of the diaphragm 60 which is urged, by a return spring 66 disposed in the vacuum chamber 64, toward the right as viewed in FIG. 1 to a position wherein the stem 54 and, thus the link 52, is located to permit the choke lever spring 46 to hold the choke valve 38 in the closed position as shown in FIG. 1.

The vacuum chamber 64 is connected in communication with the engine intake 12 downstream of the throttle valve 26 through a conduit 68 and a passage 70 in the carburetor body 16. The vent chamber 62 is vented to atmosphere through one or more ports 72 in the housing 58. When the engine is operating, the subatmospheric pressure produced in the engine intake manifold 12 creates a pressure differential across the diaphragm 60, causing the diaphragm 60 to pull the stem 54 to the left as viewed in FIG. 1 against the biasing force of the return spring 66. This movement is translated to the choke lever 44 via the link 52 and the choke lever 44 is pivoted from a first position shown in FIG. 1 corresponding to the closed position of the choke valve 38 toward a second position shown in FIG. 3 corresponding to an open position of the choke valve 38.

The choke valve 38 may "breathe," i.e., partially open against action of the choke lever spring 46, in response to the oscillating pressure in the engine intake manifold 12 during engine starting or cranking when the engine suction pressure is not sufficient to actuate the vacuum discharge assembly 56 and open the choke valve 38. The arcuate slot 50 in the choke lever 44 permits the choke lever 44 to pivot relative to the link 52, and thus permits the choke valve 38 to pivot away from the closed position in the counterclockwise direction as viewed in FIG. 1, for this "breathing." After the engine is started, the vacuum discharge assembly 56 maintains the choke valve 38 in an open position during engine idling and low speed throttle settings as shown in FIG. 3. At higher speed throttle settings (e.g., an engine speed of about 2,000 r.p.m. and above), the engine suction pressure decreases or becomes more positive, causing the stem 54 of the vacuum diaphragm assembly 56 to be moved by the return spring 66 toward the right as viewed in FIG. 1 to a position wherein the choke lever spring 46 tends to close the choke valve 38.

The throttle lever 32 and the choke valve 38 are interconnected by means for holding the choke valve 38 open independently of the vacuum diaphragm assembly 56 after the throttle lever 32 is moved from the idle position past a predetermined advance speed position and for permitting the vacuum diaphragm assembly 56 to be effective for controlling movement of the choke valve 38 when the throttle lever 32 is returned past the predetermined advance position toward the idle position. While various arrangements can be used, in the specific construction illustrated, such means include a generally L-shaped, choke pull-out lever 74 having first and second legs 76 and 78. The outer end portion 80 of the first leg 76 is pivotally mounted on a pin or shaft 82 extending laterally outwardly from the carburetor body 16 on the same side as the throttle lever 32 and the choke lever 44. The outer end portion 84 of the second leg 78 includes an edge portion 86 which is biased toward abutment with a projection 88 on the choke lever 44 (i.e., in the counterclockwise direction as viewed in FIG. 1) by a torsion spring 90 which encircles the shaft 82 with the opposite ends thereof suitably bearing against the carburetor body 16 and the outer end portion 80 of the first leg 76. The choke pull-out lever spring 90 is stronger than the choke lever spring 46, but weaker than the throttle lever spring 34, for reasons explained below.

Provided in the first leg 76 of the choke pull-out lever 74 is an elongated slot 92 extending generally transversely to the second leg 78 and slidably receiving the upper or first end of a link 94 which, at the lower or second end, is pivotally connected to the throttle lever 32. When the throttle lever 32 is in the idle position shown in FIG. 1, the choke pull-out lever 74 is located in a locked position by virtue of the upper end of the link 94 being held in engagement with the upper end of the slot 92 by the throttle lever 32. In other words, when in this position, the link 94 is located to prevent pivotal movement of the choke pull-out lever 74. Thus, the choke lever 44 can be pivoted away from the closed position against the action of the choke lever spring 46 independently of the choke pull-out lever 74, anytime the throttle lever 32 is in the idle position or at a low speed setting, by either the vacuum diaphragm assembly 56 during engine operation or in response to the oscillating pressure acting in the choke valve 38 during engine cranking.

As the throttle lever 32 is pivoted from the idle position past a predetermined advance speed position (e.g., a throttle setting corresponding to an engine speed of about 2,000 r.p.m.) in response to actuation of the throttle cable 36, the upper end of the link 94 is pulled downwardly in the choke pull-out lever slot 92 to a released position shown in FIG. 4 wherein the choke pull-out lever 74 can be pivoted by the choke pull-out lever spring 90 toward the choke lever 44 (i.e., in the counterclockwise direction as viewed in FIG. 1) and the edge portion 86 of the second leg 78 is urged into abutment with the choke lever projection 88 by the choke pull-out lever spring 90. The pivotal force exerted on the choke lever 44 by the choke pull-out lever spring 90, through the choke pull-out lever 74, is sufficient to overcome the closing force of the choke lever spring 46 and hold the choke valve 38 in the open position as shown in FIG. 4. When the throttle lever 32 is returned to the idle position, the throttle lever spring 34 exerts a sufficient pivotal force on the choke pull-out lever 74, through the throttle lever 34 and the link 94, to overcome the biasing force of the choke pull-out lever spring 90 and return the choke pull-out lever 74 to the locked position.

Summarizing the operation, the choke valve 38 is held closed by the choke lever spring 46 anytime the engine is stopped and the throttle lever 32 is in the idle position. Upon starting of the engine with the throttle lever 32 in the idle position, the vacuum diaphragm assembly 56, in response to the suction pressure present in the engine intake manifold 12, opens the choke valve 38 by rotating the choke valve 38 in a counterclockwise direction as seen in FIG. 1 and holds it open via the link 52 and the choke lever 44. As the engine speed is subsequently increased above a speed where the choke valve 38 otherwise would tend to be closed by the choke lever spring 46 because of the decreasing engine suction pressure, the choke valve 38 is mechanically held open by the throttle lever 32 by virtue of the link 94 being moved by the throttle lever 32 to a released position wherein the choke pull-out lever spring 90, acting through the choke pull-out lever 74 and the choke lever 44, overcomes the closing force of the choke lever spring 46.

When the engine speed is decreased to the predetermined level where the vacuum diaphragm assembly 56 is capable of holding the choke valve 38 open, the throttle lever spring 34, acting through the throttle lever 32 and the link 94, returns the choke pull-out lever 24 to the locked position. The vacuum diaphragm assembly 56 then holds the choke valve 38 open until the engine is stopped, at which time the choke valve 38 is closed by the choke lever spring 46. If desired, the choke valve 38 can be opened for engine starting by actuating the throttle control to pivot the throttle lever 32 to the predetermined advance speed setting wherein the choke pull-out lever 74 is released and the choke pull-out spring 90 can force the choke valve 38 open as described above.

Various of the features of the invention are set forth in the following claims

What is claimed is:

1. A carburetor for an internal combustion engine having an intake, said carburetor comprising a body defining an induction passage having an inlet and an outlet adapted to communicate with the engine intake, a choke valve pivotally mounted in said induction passage and movable between a closed position and an open position to control the admission of air into said induction passage through said air inlet, first biasing means for pivoting said choke valve toward the closed position, a choke lever connected to said choke valve for common pivotal movement therewith between first and second positions corresponding respectively to the open and closed positions of said choke valve, pressure responsive means adapted for communication with the engine intake, means connecting said pressure responsive means to said choke valve for moving said choke valve from the closed position toward the open position in response to the presence of subatmospheric pressure in the engine intake during engine operation, said means connecting said pressure responsive means to said choke valve including a first link connected between said pressure responsive means and said choke lever for pivoting said choke lever, in response to the presence of subatmospheric pressure in the engine intake, toward the second position and thereby to open said choke valve against the closing force of said first biasing means, a throttle valve pivotally mounted in said induction passage between said choke valve and said outlet and movable between an engine idle position and a range of advance speed positions, and means interconnecting said throttle valve and said choke valve for holding said choke valve in the open position independently of said pressure responsive means after said throttle valve is moved from the idle position past a predetermined advance speed position and for permitting said pressure responsive means to be effective for controlling movement of said choke valve when said throttle valve is moved past the pre-determined speed position toward the idle position, said means interconnecting said throttle valve and said choke valve including a choke pull-out lever mounted for pivotal movement between a locked position and a released position wherein said choke pull-out lever engages said choke lever and is operable for pivoting said choke lever toward the second position, second biasing means for pivoting said choke pull-out lever toward the released position and for overcoming said first biasing means, and thereby holding said choke valve in the open position when said choke pull-out lever is in the released position, a throttle lever connected to said throttle valve for common pivotal movement therewith, and means connecting said throttle lever to said choke pull-out lever for locking said choke pull-out lever in the locked position when said throttle lever is located in the idle position or between the idle position and the predetermined advance speed position, and for permitting said second biasing means to pivot said choke pull-out lever to the released position when said throttle lever is moved from the idle position past the pre-determined advance speed position.

2. A carburetor according to claim 1 including third biasing means for biasing said throttle lever toward the idle position and for overcoming said second biasing means to return said choke pull-out lever to the locked position when said throttle lever is moved past the predetermined advance speed position toward the idle position.

3. A carburetor according to claim 1 wherein said choke lever includes an arcuate slot, and said first link has a first end connected to said pressure responsive means and a second end slidably received in said choke lever slot such that said first link second end, in response to the presence of subatmospheric pressure in the engine intake, engages one end of said choke lever slot and pivots said choke lever toward the second position and such that said choke lever can pivot relative to said first link second end toward the second position.

4. A carburetor according to claim 2 wherein said choke lever is located exteriorly of and on one side of said body, said choke pull-out lever is located exteriorly of said body on the same side thereof as said choke lever, has a first leg including an elongated slot and an outer end portion pivotally mounted on said body, and has a second leg including an outer end portion adapted to engage said choke lever, said throttle lever is located exteriorly of said body on the same side thereof as said choke lever, and said means connecting said throttle lever and said choke pull-out lever includes a second link having one end pivotally connected to said throttle lever and a second end slidably received in said choke pull-out lever slot such that said second end of said second link engages one end of said choke pull-out lever slot and holds said choke pull-out lever in the locked position when said throttle lever is located in the idle position or between the idle position and the predetermined advance speed position and such that said second end of second link, in response to movement of said throttle lever from the idle position past the predetermined advance speed position, moves in said choke pull-out lever slot towards the opposite end thereof to a released position wherein said second biasing means can pivot said choke pull-out lever toward the released position.

5. A carburetor according to claim 4 wherein said choke valve is mounted on a shaft pivotally journaled in said body and including an outer end portion extending laterally outwardly from one side of said body, said choke lever is fixedly mounted on said choke valve shaft outer end portion, said first biasing means comprises a torsion spring encircling said choke valve shaft outer end portion with one end bearing against said choke valve lever and the other end bearing against said body, said choke pull-out lever is pivotally mounted on a shaft extending laterally outwardly from said body on the same side thereof as said choke lever, said second biasing means comprises a torsion spring encircling said choke pull-out lever shaft with one end bearing against said choke pull-out lever and the other end bearing against said body, said throttle valve is mounted on a shaft pivotally journaled in said body and including an outer end portion extending laterally outwardly from said body on the same side thereof as said choke lever, and said third biasing means comprises a torsion spring encircling said throttle lever shaft outer end portion with one end bearing against said throttle lever and the other end bearing against said body.

* * * * *